United States Patent [19]

Lass

[11] Patent Number: 4,485,974

[45] Date of Patent: Dec. 4, 1984

[54] VERTICAL ROLLER MILL AND METHOD OF USE THEREOF

[75] Inventor: Finn Lass, Copenhagen, Denmark

[73] Assignee: F. L. Smidth & Co., Cresskill, N.J.

[21] Appl. No.: 331,017

[22] Filed: Dec. 15, 1981

[30] Foreign Application Priority Data

Dec. 17, 1980 [GB] United Kingdom ..... 8040462

[51] Int. Cl.[3] ..... B02C 4/00

[52] U.S. Cl. ..... 241/30; 241/37; 241/121

[58] Field of Search ..... 241/30, 37, 117, 118, 241/119, 120, 121, 122, 127, 132, 36

[56] References Cited

U.S. PATENT DOCUMENTS 4,002,299 1/1977 Skalka ..... 241/37

4,212,429 7/1980 Cuvelier et al. ..... 241/36 X 4,382,558 5/1983 Svensson ..... 241/37 X 4,382,561 2/1983 Andersen et al. ..... 241/121

*Primary Examiner*—Howard N. Goldberg

*Assistant Examiner*—Timothy V. Eley

*Attorney, Agent, or Firm*—Pennie & Edmonds

[57] ABSTRACT

The present invention relates to a vertical roller mill including a grinding roller which is urged against a grinding path on a grinding table by a hydraulic cylinder. The loading on the roller is measured by a transducer and the acceleration of the roller by an accelerometer. Resulting signals are combined at a controller which controls a valve through which hydraulic fluid is supplied to the hydraulic cylinder, so that the loading is compensated for the influence of the instantaneous velocity and acceleration of the roller.

10 Claims, 1 Drawing Figure

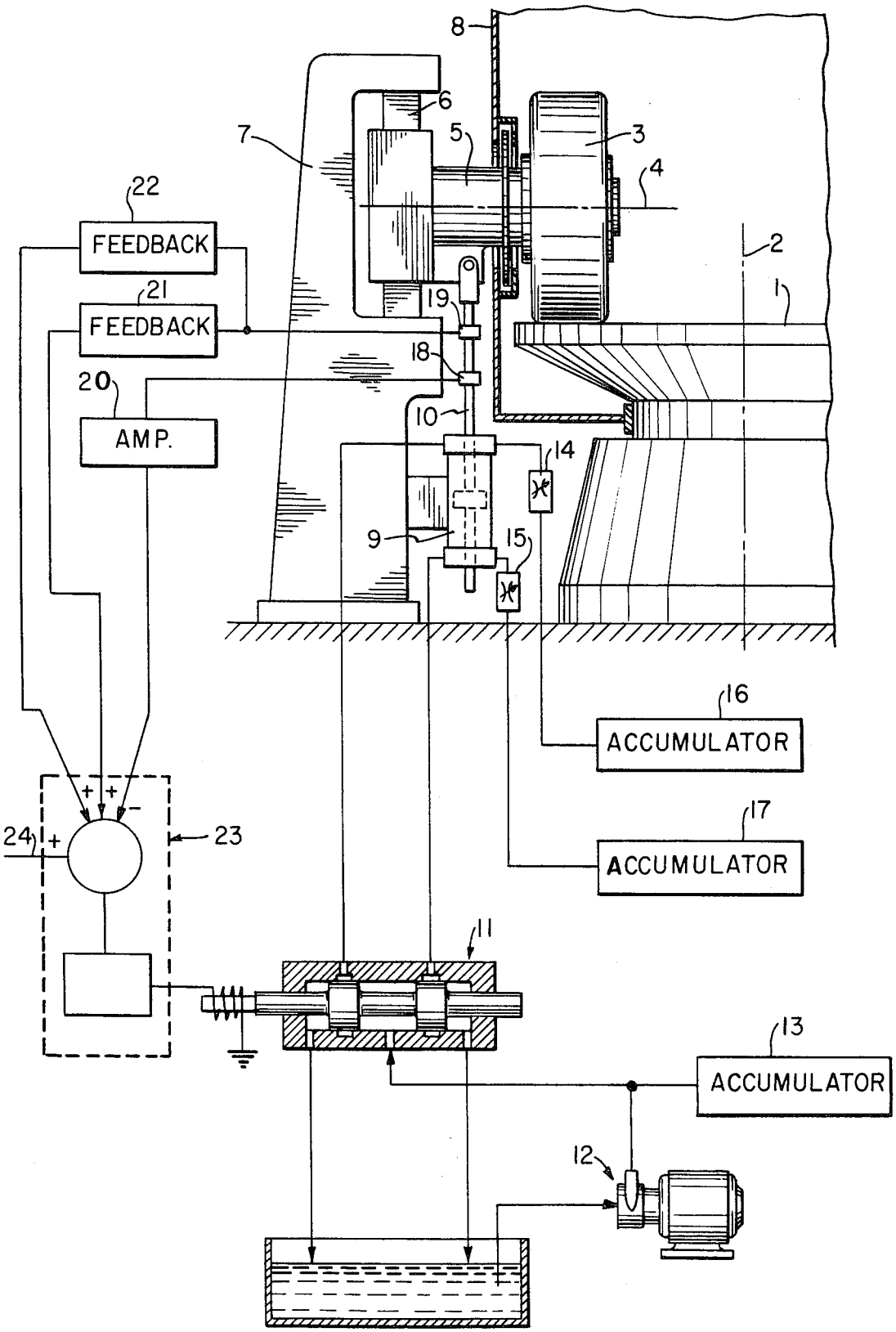
8
6
7
5
3
4
22
FEEDBACK
2
21
FEEDBACK
19
1
18
20
AMP.
10
14
9
15
16
ACCUMULATOR
17
ACCUMULATOR
24
23
11
13
ACCUMULATOR
12

VERTICAL ROLLER MILL AND METHOD OF USE THEREOF

TECHNICAL FIELD

The present invention relates to a method of controlling the grinding roller pressure in a vertical roller mill.

BACKGROUND ART

In vertical roller mills which comprise at least one grinding roller urged by a loading force against the grinding path of a grinding table rotating about a vertical axis, it is known to use single acting hydraulic cylinders whose active piston end is influenced by a constant grinding roller loading pressure.

It is also known to use a variable pressure in the cylinder, which is regulated proportionately with the grinding cushion thickness.

Furthermore, it is known to use double acting cylinders with different preset pressures at opposite ends of the piston, thus enabling the cylinder to prevent the rollers from suddenly dropping down onto the grinding path because of large variations in the grinding cushion thickness and especially because of a momentary absence of any grinding cushion. In this way, large impacts and the consequent detrimental effect on the grinding table and gear etc. can to some extent be avoided or at any rate reduced.

However, as will be known, comparatively large variations occur in the grinding power absorption in large roller mills, and the dynamic loads between the grinding rollers and the grinding table can produce very powerful, detrimental single impacts. Such variations are probably a consequence of the nature of the grinding cushion rolled over. The above known system with double acting cylinders to prevent the grinding rollers from suddenly dropping down is not suited for compensating for such dynamic load variations because of its relatively slow reaction.

I have invented a vertical roller mill and method of controlling the mill which eliminate the above disadvantages of the known hydraulic loading systems.

DISCLOSURE OF THE INVENTION

According to the invention, a method of the kind described is characterised in that the instantaneous loading force on the roller is derived and converted into a loading signal; and in that the acceleration and velocity of the roller perpendicular to the grinding path are derived and converted into signals which are combined with the loading signal to produce a final signal controlling means for developing the loading force whereby the loading force is automatically compensated for the influence of the roller velocity and acceleration upon the roller pressure. The method of the present invention may be practiced by measuring only the acceleration of the roller perpendicular to the grinding path as opposed to measuring both the acceleration and velocity of the roller.

In this way, a constant, desired roller pressure is obtained without the detrimental, dynamic influences otherwise known, i.e., impacts upon and shakings of the various mill parts.

The invention also includes a vertical roller mill for carrying out the new method, the mill comprising at least one grinding roller which is urged by a double acting hydraulic cylinder against a grinding table rotating about a vertical axis, and being characterised in that both ends of the hydraulic cylinder are connected to an electro hydraulic servo valve controlled by a loading controller; in that a force transducer for measuring the roller loading force and an accelerometer for measuring the acceleration of the roller in relation to the grinding path is incorporated in the cylinder or its connection to the roller; in that the force transducer is coupled to the controller via a signal amplifier while the accelerometer is coupled to the controller via signal feedback units for the velocity and acceleration of the roller; and in that the controller imparts an output signal to the servo valve to produce a loading force compensated for the instantaneous mass force of the roller.

It should be noted that the vertical roller mill of the present invention includes at least one roller. In many instances, such vertical roller mills include a plurality of rollers in which case the specific aspects of the present invention as described hereinbelow are applicable to measurements of individual rollers, or if so desired, to measurements of one roller on a multi-roller vertical roller mill.

BRIEF DESCRIPTION OF THE DRAWINGS

The present invention is described in detail below with reference to the drawing which is a diagrammatic vertical sectional view of a vertical roller mill constructed according to the present invention.

BEST MODE FOR CARRYING OUT THE INVENTION

Referring to the drawings, the mill has a grinding table 1 rotating about a vertical axis 2. One or more grinding rollers 3 roll on the grinding table, the axis 4 of each individual roller being stationary in the horizontal plane. In the example shown the roller axis is displaceable in the vertical plane parallel to the direction shown, as the roller suspension 5 is vertically movable in a parallel guide arrangement 6 on a frame 7. The grinding table 1 and the grinding roller or rollers 3 are encased in a mill housing 8 in a manner known per se.

The grinding pressure exerted by the roller 3 against a grinding path of the grinding table 1 is provided by a hydraulic cylinder 9 whose piston or draw bar 10 is connected to the roller suspension 5.

The cylinder 9 is double acting, and flow and flow direction as well as pressure at the two cylinder ends are controlled by an electro-hydraulic servo valve 11, being fed by a pump 12 having a respective hydraulic accumulator 13.

Each of the two ends of the cylinder 9 is connected via an adjustable flow resistance 14 and 15 to a hydraulic accumulator 16 and 17.

A force transducer 18 measuring the tensioning i.e., loading force for the roller 3 and an accelerometer 19 measuring the acceleration of the roller 3 are incorporated in the piston or draw bar 10.

The force transducer 18 is, via an amplifier 20, and the accelerometer 19 is, via feedback units 21 and 22, connected to a controller 23 controlling the servo valve 11.

In principle the control system operates in the manner to be described. The detailed construction of the individual units of the system, i.e., amplifier, couplings, controller, servo valve and so on are known within the technology.

The desired grinding pressure against the material to be ground on the grinding table 2, the so-called grinding cushion, is preset on a potentiometer producing a corresponding signal which is passed to the controller 23 at 24. The force transducer 18 in the piston rod 10 measures the tensioning force of the cylinder 9 and produces a signal representative of this force, which signal via the amplifier 20 is fed back to the controller 23. The two signals are compared in the controller. Any difference causes the controller to give off an output signal which activates the servo valve in such a way that the actual grinding pressure is adjusted towards the one preset on the potentiometer. This procedure is continued until the desired roller pressure and the tensioning force correspond.

Because of the two hydraulic accumulators 16 and 17 of the cylinder 9, the tensioning force for the roller 3 in case of comparatively slow roller movements is practically constantly independent of the roller displacement or position in relation to the grinding table 1. Conversely, in the case of comparatively quick movements the roller mass force will constantly influence and adjust the roller pressure against the grinding cushion. At worst, the roller may bounce and lose contact with the grinding cushion with subsequent detrimental impacts upon the grinding table and roller suspension when the roller drops onto the grinding cushion again.

The influence of the mass force on the roller pressure can be eliminated by controlling the flow to the cylinder 9 in such a way that the differential pressure in the cylinder is varied in size and phase corresponding to the mass force.

For this purpose, the accelerometer 19 is used, for which, via the feedback units 21 and 22, signals representing both velocity and acceleration of the vertical movements of the roller are transmitted to the summation point of the controller 23.

By this, it can be achieved that the output signal of the controller 23 controls the servo valve 11 so as to produce in the cylinder 9 flow and pressure conditions producing a roller tensioning compensated for the roller mass force and consequently a constant grinding cushion pressure.

It should be noted that naturally the hydraulic system must be dimensioned so as to be capable of producing the necessary force and effect and operate sufficiently fast, but such conditions can be fulfilled by known technology.

I claim:

1. A method of controlling the grinding roller pressure in a vertical roller mill which comprises at least one grinding roller urged by a loading force perpendicularly against the grinding path of a grinding table rotating about a vertical axis, means for determining the loading force of said roller and converting said loading force into a loading signal, and means for determining the acceleration and velocity of said roller in a direction perpendicular to said grinding table and converting said acceleration and velocity into respective signals, characterized in that the instantaneous loading force on the roller is derived and converted into a loading signal, and in that the acceleration and velocity of the roller in a direction perpendicular to the grinding path are derived and converted into acceleration and velocity signals, respectively, which are combined with the loading signal to produce a final signal controlling means for developing the loading force such that the loading force is automatically compensated for the influence of the roller velocity and acceleration upon the roller pressure so as to maintain a predetermined roller pressure and to prevent the roller from dropping down onto the grinding table.

2. A method of controlling the grinding roller pressure in a vertical roller mill having at least one grinding roller urged by a loading force perpendicularly against the grinding path of a grinding table rotating about a vertical axis, means for determining the loading force of said roller and converting said loading force into a loading signal, and means for determining the acceleration of said roller in a direction perpendicular to said grinding table and converting said acceleration into acceleration and velocity signals, comprising deriving the instantaneous loading force on said roller and converting said loading force into a respective loading signal, deriving at least the acceleration of said roller perpendicular to said grinding path and converting said acceleration into acceleration and velocity signals, comparing said loading signal with said acceleration and velocity signals to produce a final signal controlling means for determining the loading force, automatically compensating said loading force in dependence upon said final signal so as to compensate for the influence of said roller acceleration upon the roller pressure so as to maintain a predetermined roller pressure and to prevent the roller from dropping down onto the grinding table.

3. A method of controlling the grinding roller pressure in a vertical roller mill having a plurality of grinding rollers urged by a loading force perpendicularly against the grinding path of a grinding table rotating about a vertical axis, means for determining the loading force of each said roller and converting said loading force into a loading signal, and means for determining the acceleration and velocity of each said roller in a direction perpendicular to said grinding table and converting said acceleration and velocity into respective signals, comprising deriving the instantaneous loading force on said rollers and converting each said loading force into a respective loading signal, deriving at least the acceleration of each of said respective rollers perpendicular to said grinding path and converting each said acceleration into acceleration and velocity signals, comparing said loading signals with said respective acceleration and velocity signals to produce a final signal controlling means for developing the loading force of each respective roller, automatically compensating said loading force in dependence upon said compared signals so as to compensate for the influence of said roller acceleration upon the roller pressure so as to maintain a predetermined roller pressure and to prevent the roller from dropping down onto the grinding table.

4. A vertical roller mill comprising at least one grinding roller which is urged by a loading force of a double acting hydraulic cylinder perpendicularly against a grinding table rotating about a vertical axis, characterized in that both ends of the hydraulic cylinder are connected to an electro hydraulic servo valve controlled by a loading controller, in that a force transducer for measuring the roller loading force and an accelerometer for measuring the acceleration of the roller in a direction perpendicular to the grinding path is incorporated in the cylinder, in that the force transducer is coupled to the controller via a signal amplifier while the accelerometer is coupled to the controller via signal feedback units for providing signals representative of the velocity and acceleration of the roller, and in that the controller imparts an output signal to the servo valve to provide a loading force compensated for the instantaneous force of the roller acting against the grinding table so as to maintain a predetermined roller pressure and to prevent the roller from dropping down onto the grinding table.

5. A vertical roller mill which comprises at least one grinding roller, a grinding table adapted for rotation about a vertical axis, double acting hydraulic cylinder means for providing a loading force for urging said grinding roller against said grinding table, means for determining the loading force of said roller and converting said loading force into a loading signal, means for determining at least the acceleration of said roller in a direction perpendicular to said grinding path and converting said acceleration into acceleration and velocity signals whereby said signals are compared with said loading signal to produce a final signal controlling means for adjusting the loading force, means for automatically compensating the loading force to account for the influence of said acceleration of said roller upon the pressure caused by said roller so as to maintain a predetermined roller pressure and to prevent the roller from dropping down onto the grinding table.

6. A vertical roller mill which comprises at least one grinding roller, a grinding table adapted for rotation about a vertical axis, double acting hydraulic cylinder means for providing a loading force for urging said grinding roller against said grinding table, means for determining the loading force of said roller and converting said loading force into a loading signal, means for determining the acceleration and velocity of said roller in a a direction perpendicular to said grinding path and converting said acceleration and velocity into respective signals whereby said signals are combined with said loading signal to produce a final signal controlling means for adjusting the loading force, means for automatically compensating the loading force to account for the influence of said acceleration of said roller upon the pressure caused by said roller so as to maintain a predetermined roller pressure and to prevent the roller from dropping down onto the grinding table.

7. A vertical roller mill which comprises a plurality of grinding rollers, a grinding table adapted for rotation about a vertical axis, double acting hydraulic cylinder means for providing a loading force for urging said grinding rollers against said grinding table, means for determining the loading force of said rollers and converting said loading force into a loading signal, means for determining the acceleration and velocity of each of said rollers in a direction perpendicular to said grinding path and converting said acceleration and velocity into respective signals whereby said respective signals are combined with said respective loading signal to produce a final signal controlling means for adjusting the loading force of the respective roller, means for automatically compensating the loading force of said roller to account for the influence of said acceleration of said roller upon the pressure caused by said roller so as to maintain a predetermined roller pressure and to prevent said roller from dropping down onto the grinding table.

8. A method of controlling the grinding roller pressure in a vertical roller mill which comprises a plurality of grinding rollers each urged by a separate loading force perpendicularly against the grinding path of a grinding table rotating about a vertical axis, characterised in that each instantaneous loading force on the rollers is derived and converted into a respective loading signal, and in that the acceleration of the roller in a direction perpendicular to the grinding path is derived and converted into acceleration and velocity signals, respectively, which are combined with the loading signal to produce a final signal controlling means for developing the loading force whereby the loading force is automatically compensated for the influence of the roller velocity and acceleration upon the roller pressure so as to maintain a predetermined roller pressure and to prevent the roller from dropping down onto the grinding table.

9. A vertical roller mill including at least one grinding roller having a roller suspension which is vertically movable in a parallel guide arrangement on a frame, said at least one grinding roller being urged by a loading force of a double acting hydraulic cylinder perpendicularly against a grinding table rotating about a vertical axis, the hydraulic cylinder having a piston which is connected to the roller suspension, characterized in that both ends of the hydraulic cylinder are connected to an electro hydraulic servo valve fed by a pump having a respective hydraulic accumulator, said electro hydraulic servo valve being controlled by a loading controller, in that a force transducer for measuring the roller loading force and an accelerometer for measuring the acceleration of the roller in a direction perpendicular to the grinding path is incorporated in the cylinder piston, in that the force transducer is coupled to the controller via a signal amplifier while the accelerometer is coupled to the controller via a first and a second signal feedback units for providing signals representative of the acceleration and velocity, respectively, of the roller, and in that the controller imparts an output signal to the servo valve to provide a loading force compensated for the instantaneous force of the roller acting against the grinding table so as to maintain a predetermined roller pressure and to prevent the roller from dropping down onto the grinding table.

10. A vertical roller mill comprising at least one grinding roller which is urged by a loading force of a double acting hydraulic cylinder perpendicularly against a grinding table rotating about a vertical axis, characterized in that both ends of the hydraulic cylinder are connected to an electro hydraulic servo valve controlled by a loading controller, in that a force transducer for measuring the roller loading force and an accelerometer for measuring the acceleration of the roller in a direction perpendicular to the grinding path is incorporated in the cylinder connection to the roller, in that the force transducer is coupled to the controller via a signal amplifier while the accelerometer is coupled to the controller via signal feedback units for providing signals representative of the velocity and acceleration of the roller, and in that the controller imparts an output signal to the servo valve to provide a loading force compensated for the instantaneous force of the roller acting against the grinding table so as to maintain a predetermined roller pressure and to prevent the roller from dropping down onto the grinding table.

* * * * *